United States Patent [19]

Wargula

[11] Patent Number: 4,632,487

[45] Date of Patent: Dec. 30, 1986

[54] ELECTRICAL LEAD RETAINER WITH COMPRESSION SEAL

[75] Inventor: Lucian G. Wargula, Oshkosh, Wis.

[73] Assignee: Brunswick Corporation, Skokie, Ill.

[21] Appl. No.: 818,652

[22] Filed: Jan. 13, 1986

[51] Int. Cl.[4] ..... H01R 13/52; H01R 13/56

[52] U.S. Cl. ..... 339/103 B; 174/65 SS; 339/94 A

[58] Field of Search ..... 339/94 A, 103 B; 285/319, 320, 921; 174/65 SS, 152 G

[56] References Cited

U.S. PATENT DOCUMENTS

| | | | |
|---|---|---|---|
| 885,836 | 4/1908 | Bullock | 174/152 G |
| 3,853,338 | 12/1974 | Wilson | 285/921 X |
| 4,226,432 | 10/1980 | Nakamizo | 174/152 G X |

FOREIGN PATENT DOCUMENTS

| | | | |
|---|---|---|---|
| 1386348 | 12/1964 | France | 174/65 SS |

*Primary Examiner*—Eugene F. Desmond

*Attorney, Agent, or Firm*—Andrus, Sceales, Starke & Sawall

[57] ABSTRACT

An electrical lead retainer (2) with compression seal (4) is provided for a terminal receptacle post (6) of an ignition coil tower for gasoline engines in corrosive environments, including the high tension lead in marine applications. An insulated electrical wire (16) is inserted into the post, and an annular grommet (20) around the wire is compressed against the post and against the wire to prevent moisture from creeping across the post opening and from creeping along the wire into the post opening. An end cap (22) has an aperture (28) through which the wire extends and has a pair of flexible outer locking tabs (24, 26) engaging the backside of a flange (14) on the post in snap-lock manner to hold the cap on the post and compress the grommet. The cap has an internal annular recess (34) forming a step shoulder (56) with the aperture (28) and compressing the grommet against an annular collar (10) on the post. The internal annular recess (34) has substantially the same diameter as the outer diameter (42) of the grommet to restrict expansion of the outer diameter of the grommet upon compression of the latter by the step shoulder (56) and instead cause expansion of the grommet inwardly against the wire.

7 Claims, 4 Drawing Figures

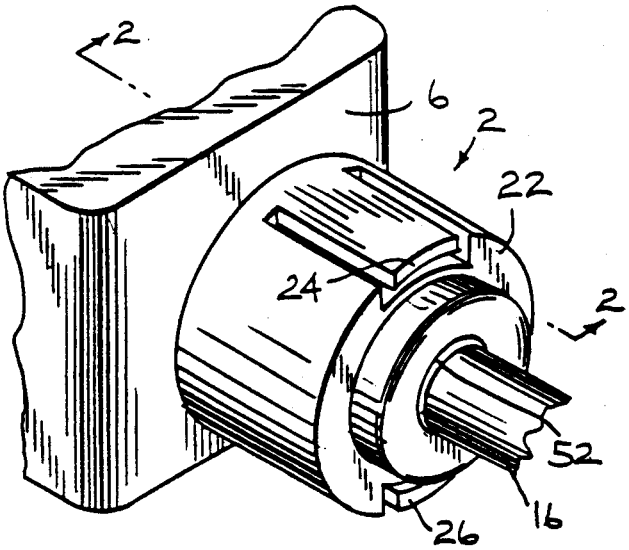
FIG. 1
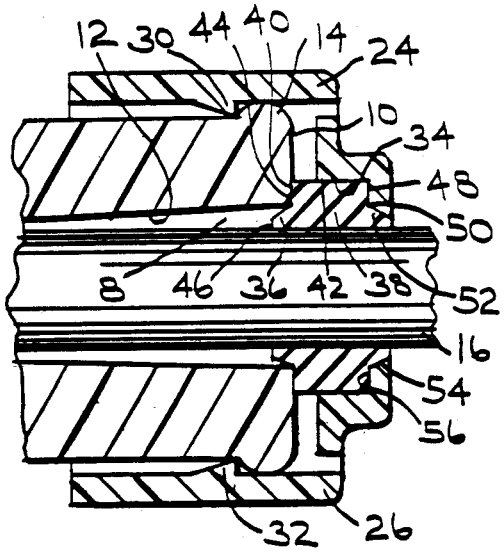
FIG. 2
FIG. 4
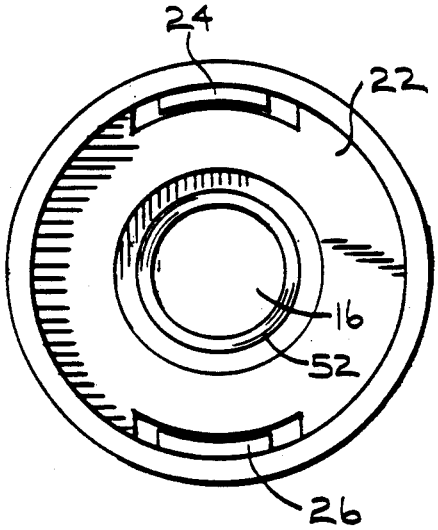
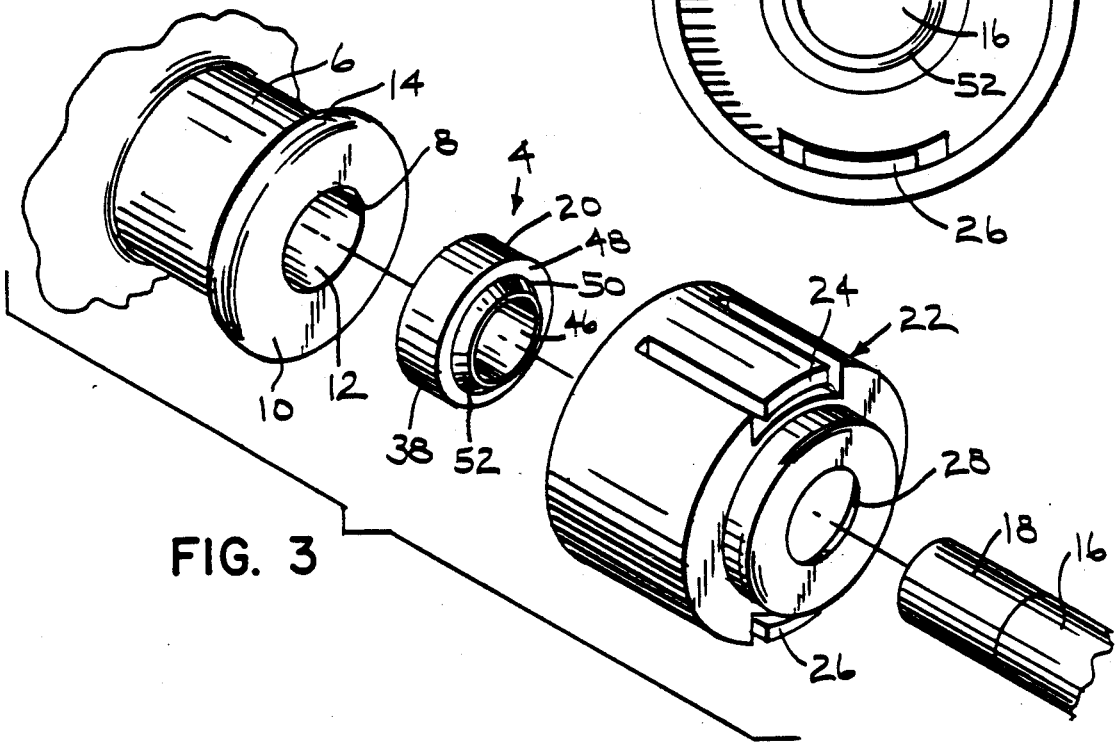
FIG. 3

ELECTRICAL LEAD RETAINER WITH COMPRESSION SEAL

BACKGROUND AND SUMMARY

The invention relates to electrical lead retainers and connectors, particularly for use in harsh and corrosive environments.

The invention addresses and solves the need for a simple and effective seal for eliminating ignition failure due to corrosion within iginition coil towers used on two and four cycle gasoline engines in marine propulsion systems. The invention provides a seal which prevents moisture from creeping across the opening in the coil tower post, and also prevents moisture from creeping along the wire within the post.

BRIEF DESCRIPTION OF THE DRAWINGS

FIG. 1 is a perspective view illustrating an assembled condition of an electrical lead retainer in accordance with the invention.

FIG. 2 is sectional view taken along line 2—2 of FIG. 1.

FIG. 3 is an exoloded perspective view of the retainer of FIG. 1.

FIG. 4 is an end elevation view of the retainer of FIG. 1.

DETAILED DESCRIPTION

FIGS. 1 and 3 show an electrical lead retainer 2 with compression seal 4. The ignition coil of a gasoline engine has an electrically insulating tower or terminal receptacle post 6 having an opening 8 defined by an annular collar 10 and an inner cylindrical side wall 12 and a conductive female socket therein (not shown). The terminal receptacle post has an annular flange 14 around its perimeter which is engaged by snap-locking tabs, to be described. An insulated electrical wire 16 has a conductive male plug or lead 18 at its end and is inserted into opening 8 in post 6 to contact the female socket therein, and provides the high tension connection for the ignition coil of the engine.

Seal 4 is provided by a compressible annular grommet 20 of rubber or like material around wire 16 and engaging annular collar 10, FIG. 2. A boot or cap 22 of polyester or like material is around wire 16 and has releasable snap-lock means provided by a pair of flexible outer locking tabs 24 and 26 engaging the back side of flange 14, FIG. 2, to hold cap 22 on post 6 and compress grommet 20. Cap 22 has an aperture 28 through which wire 16 extends. During assembly, wire 16 is inserted leftwardly, in FIG. 3, through aperture 28 in cap 22 and is loosely received therein, after which grommet 20 is slid rightwardly over the left end of wire 16 and fits snugly therearound, to be described. The wire is then inserted leftwardly into opening 12 in post 6 such that lead 18 is within opening 12 and contacts the female socket, and grommet 20 engages annular collar 10. Cap 22 is then slid leftwardly and pushed onto post 6 in a push-on snap-locking manner, with tabs 24 and 26 deflecting radially outwardly as inner protrusions 30 and 32, FIG. 2, slide past annular flange 14 and then snap back radially inwardly and engage the back side thereof. To release the cap and remove it from post 6, tabs 24 and 26 are flexed outwardly with one's fingers or a tool, to move protrusions 30 and 32 radially outboard of flange 14 to enable axial sliding therepast.

Cap 22 has an internal annular recess 34, FIG. 2, of substantially the same diameter as the outer diameter of grommet 20, and receives grommet 20 to restrict expansion of the outer diameter of the grommet upon compression of the grommet by cap 22 against annular collar 10 and instead cause expansion of grommet 20 inwardly against wire 16. This provides a tight seal which prevents moisture from creeping along wire 16 within post 6 and also tightly grips the wire to prevent the wire from being pulled out of the post. Grommet 20 has a first portion 36, FIG. 2, in opening 8 in the post between wire 16 and the inner cylindrical side 12 of the opening. Grommet 20 has a second portion 38 with an annular face 40 engaging annular collar 10 of the post. The grommet second portion 38 has an outer diameter at 42 substantially the same as and retained in annular recess 34 in cap 22. Annular face 40 of grommet second portion 38 extends radially inwardly from outer diameter 42 to an intermediate diameter at 44 substantially the same as the diameter of opening 8 in post 6. Grommet first portion 36 starts at intermediate diameter 44 and extends frustoconically leftwardly away therefrom and into opening 8 in post 6 to an inner diameter at 46 substantially the same as the diameter of wire 16.

Grommet second portion 38 has a second annular face 48, FIGS. 2 and 3, on the opposite side thereof from first annular face 40. Second annular face 48 extends radially inwardly from outer diameter 42 to an intermediate diameter at 50. Grommet 20 has a third portion 52 starting at intermediate diameter 50 and extending frustoconically rightwardly away therefrom to inner diameter 46 substantially the same as the diameter of wire 16. Aperture 28 in end cap 22 is frustoconically tapered at 54 to mate with and engage grommet third portion 52. End cap 22 has an annular step shoulder 56 between recess 34 and the frustoconical aperture at 54. Step shoulder 56 engages second annular face 48 of the grommet and compresses first annular face 40 of the grommet against annular collar 10 of the post to provide a seal against annular collar 10 and prevent moisture from creeping thereacross into opening 8.

It is recognized that various equivalents, alternatives and modifications are possible within the scope of the appended claims.

I claim:

1. An electrical lead retainer with compression seal comprising:

a terminal receptacle post having an opening defined by an annular collar and an inner cylindrical sidewall and having an exterior sidewall with snap-lock receiving means;

an insulated electrical wire inserted into said opening in said post;

a compressible annular grommet around said wire and engaging said annular collar; and a cap around said wire and having releasable snap-lock means engaging said snap-lock receiving means to hold said cap on said post and compressing said grommet, and having an internal annular recess of substantially the same diameter as the outer diameter of said grommet and receiving said grommet to restrict expansion of the outer diameter of said grommet upon compression of the latter by said cap against said annular collar and instead cause expansion of said grommet inwardly against said wire to provide a seal which prevents moisture from creeping along said wire within said post and also to tightly grip said wire and prevent said wire from being pulled out of said post.

2. The invention according to claim 1 wherein said grommet has a first portion in said opening in said post between said wire and said inner side wall of said opening, and has a second portion with an annular face engaging said annular collar of said post.

3. The invention according to claim 2 wherein:

said grommet second portion has an outer diameter substantially the same as and retained in said annular recess in said cap;

said annular face of said grommet second portion extends radially inwardly from said outer diameter to an intermediate diameter substantially the same as the diameter of said opening in said post; and said grommet first portion starts at said intermediate diameter and extends frustoconically into said opening in said post to an inner diameter substantially the same as the diameter of said wire.

4. The invention according to claim 3 wherein:

said grommet second portion has a second annular face on the opposite side thereof from said first annular face, said second annular face extending radially inwardly from said outer diameter to an intermediate diameter;

said grommet has a third portion starting at said last mentioned intermediate diameter and extending frustoconically away therefrom to an inner diameter substantially the same as the diameter of said wire.

5. The invention according to claim 4 wherein said end cap has an aperture therethrough through which said wire extends, said aperture being frustoconically tapered to mate with and engage said third portion of said grommet.

6. The invention according to claim 5 wherein said end cap has an annular step shoulder between said recess and said frustoconical aperture and engaging said second annular face of said grommet second portion.

7. An electrical lead retainer with compression seal comprising:

a terminal receptacle post having an opening defined by an annular collar and an inner cylindrical sidewall and having an annular flange around its perimeter;

an insulated electrical wire inserted into said opening in said post;

a compressible annular grommet around said wire and engaging said annular collar; and an end cap having an aperture therethrough through said wire extends and having a pair of flexible outer locking tabs engaging the backside of said flange to hold said cap on said post and compressing said grommet, said cap having an internal annular recess forming a step shoulder with said aperture which step shoulder engages and compresses said grommet against said annular collar, said internal annular recess having substantially the same diameter as the outer diameter of said grommet to restrict expansion of the outer diameter of said grommet upon compression of the latter by said step shoulder and instead cause expansion of said grommet inwardly against said wire to provide a seal which prevents moisture from creeping along said wire within said post and also to tightly grip said wire and prevent said wire from being pulled out of said post, and to provide a seal against said annular collar to prevent moisture from creeping thereacross into said opening.

* * * * *